US006811336B2

(12) United States Patent
Sarnstrom

(10) Patent No.: US 6,811,336 B2
(45) Date of Patent: Nov. 2, 2004

(54) REGISTRATION CAM FOR A PRINTING PRESS

(75) Inventor: Todd Sarnstrom, Ellsworth, WI (US)

(73) Assignee: Jostens, Inc., Minneapolis, MN (US)

( * ) Notice: Subject to any disclaimer, the term of this patent is extended or adjusted under 35 U.S.C. 154(b) by 0 days.

(21) Appl. No.: 09/996,158

(22) Filed: Nov. 28, 2001

(65) Prior Publication Data

US 2003/0099499 A1 May 29, 2003

(51) Int. Cl.[7] ..... B41J 11/10; B41J 11/42

(52) U.S. Cl. ..... 400/653; 400/579; 400/630; 400/631; 400/632.2; 400/633; 101/474; 355/202; 271/261

(58) Field of Search ..... 400/653, 633, 400/577, 630, 631, 632.2, 579, 632.1, 633.1, 633.2; 271/261; 355/202; 101/474; 33/613

(56) References Cited

U.S. PATENT DOCUMENTS 2,535,725 A 12/1950 Curtis
3,616,055 A 10/1971 Mages
3,814,010 A * 6/1974 Stanchev et al. ..... 101/90
3,832,943 A 9/1974 Kirby, Jr.
4,330,117 A 5/1982 Weisbach
4,383,760 A 5/1983 Deter et al.
4,512,561 A 4/1985 Ury
4,959,910 A 10/1990 Hamilton
4,987,448 A * 1/1991 Chikama ..... 355/205
5,596,929 A 1/1997 Fricke et al.
5,947,469 A * 9/1999 Henn et al. ..... 271/228

* cited by examiner

*Primary Examiner*—Andrew H. Hirshfeld
*Assistant Examiner*—Marvin P. Crenshaw
(74) *Attorney, Agent, or Firm*—Briggs & Morgan, P.A.

(57) ABSTRACT

A register cam and a printing press incorporating the register cam are disclosed. The register cam permits the selection of alternative configurations that permit the alteration of parameters of the registration without the removal of the register cam from the printing press. The register cam can have one or more arms movably connected to and extending from the body. The one or more arms include at least two faces with each face having a distinct profile such that when an arm is in a first orientation a first face is presented to contact a gripper arm of the printing press and in a second orientation a second face is presented to contact the gripper arm of the printing press.

7 Claims, 4 Drawing Sheets

REGISTRATION CAM FOR A PRINTING PRESS

BACKGROUND OF THE INVENTION

1. Field of the Invention

The present invention relates generally to printing presses and, more particularly, to register cams for use with printing presses.

2. Description of the Related Art

The modern automatic platen press has not substantially changed since the introduction of this type of press in the early 1800's. Basically, a platen press positions a substrate or print media, such as paper, on a platen and brings the substrate into contact with a die or form to print an image on the media. In operation, a number of additional steps are also involved. Initially, the dies or forms for printing are set in a form which is secured to a back-plate to properly position the characters or images for printing. Ink is applied to the raised surface of dies or forms. These raised surfaces define the characters or image to be printed. Finally, the print media is placed on the platen, precisely aligned and brought into contact with the form or die containing the characters or image by movement of the of the platen toward the back-plate. As the print media is pressed between the platen and the raised surfaces of the dies or forms, the image or characters is transferred to the print media. The particular mechanisms to carry out the printing process may vary from press to press but the main components of the modern platen press are generally similar or analogous. Although, in theory, the process is relatively simple, the particular components required to carry out this process are relatively complex.

Particularly with regard to the repeated positioning of the print media, the components of the platen press must act in precise harmony. A platen press typically uses a register assembly to precisely place the print media on the platen. The print media is received on the platen and transversely positioned to either left or right with a register gauge of the register assembly to precisely position the media for printing. Using the Kluge Automatic Platen Press manufactured by Brandtjen and Kluge of St. Croix Falls, Wis. as a specific example, the register gauge is one component of a cam-operated register mechanism that functions to precisely position the print media. The cam-operated register mechanism of the Kluge Automatic Platen Press includes a side register gauge as described-above to transversely push the printing media over the platen. The register gauge is mounted on a register rod. The register rod passes through an eye in a connecting rod that is attached at an opposite end to the register cam. To change between right and left registration, prior platen presses have required the removal of the registration cam and replacement with a separate registration cam having a reverse orientation of registration. The removal of a register cam requires the removal of a number of bolts and their subsequent replacement to secure the alternative register cam. This substitution procedure is both time consuming and imprecise, frequently requiring multiple adjustments to for the proper functioning of the press after replacement. Thus, the replacement of the register cam can require skilled labor adding to the costs for printing and decreasing profits. Further, the changing of registration creates the opportunity for loosing the nuts and bolts, or screws used to fasten the register cam to the registration assembly. If replacement parts are unavailable, valuable printing time above and beyond the normal extended time for replacing a register cam can be lost.

Therefore, a need exists for a platen press that permits a simple and cost effective apparatus and method for changing the direction or degree of registration. Further, a need exists for a register cam that does not require the removal of the cam from the press to facilitate changing the direction or degree of registration.

SUMMARY OF THE INVENTION

The present invention meets the above needs and provides additional improvements and advantages that will be recognized by those skilled in the art upon review of the present disclosure. In a preferred form the present invention provides a simple, reliable apparatus and methods for changing the rate, degree or direction of registration in a printing press.

In one aspect of the present invention, a register cam including a body and at least two cam arms is provided. The cam arms secured to and extending outwardly from the body. The cam arms can be movably connected to the body to permit the cam arms to be locked in one of a first position and a second position relative to the body. In the first position, a first face of the register cam contacts an edge of a gripper bar and in the second position a second face contact an edge of the gripper bar. The body can include a longitudinal bore and a transverse cavity. The transverse cavity can being shaped to securedly and removably receive a detent that can extend from an axis which connects the at least two cam arms. The detent can be shaped to be received within the transverse cavity to lock the at least two cam arms in one of the first and second positions. A rod can also be secured to the axis and can extends from the axis. When a rod is included, the rod can extend into the longitudinal bore of the body to rotatably secure the at least two cam arms to the body. A set collar can also be secured to the rod to retain the shaft within the longitudinal bore. The body can include a slot to receive the set collar. The slot can be coextensive with at least a portion of the longitudinal bore so that the set collar can positioned within a slot. The rod can include a compressible element secured between a first end of the slot and the set collar. Thus, the compressible element can compressionally secure the detent within the transverse cavity of the body and prevent the rotation of the at least two cam arms relative to the body around a longitudinal axis of the rod. The compressible element can be a coil spring positioned about the rod between the first end of the slot and the set collar.

In another aspect of the present invention, a register cam having a body and at least one cam arm is provided. The at least one cam arm secured to and extending from the body. The at least one cam can be secured to the body to permit the arm to be rotated between at least a first position and a second position. The cam arm includes a first face and a second face. The first face having a first profile and the second cam having a second profile.

It is thus an object of the present invention to provide novel apparatus and methods for altering the registration of print media in a printing press.

It is further an object of the present invention to provide such novel apparatus and methods which can alter the registration of a printing press that is relatively simple and reliable.

It is further an object of the present invention to provide such novel apparatus and methods which can alter the registration of a printing press expediently eliminating the downtime associated with changing traditional register cams.

It is further an object of the present invention to provide such novel apparatus and methods which can alter the registration of a printing press by hand without the need for substantial additional tools.

BRIEF DESCRIPTION OF THE DRAWINGS

The illustrative embodiment may best be described by reference to the accompanying drawings where.

Figure 1:
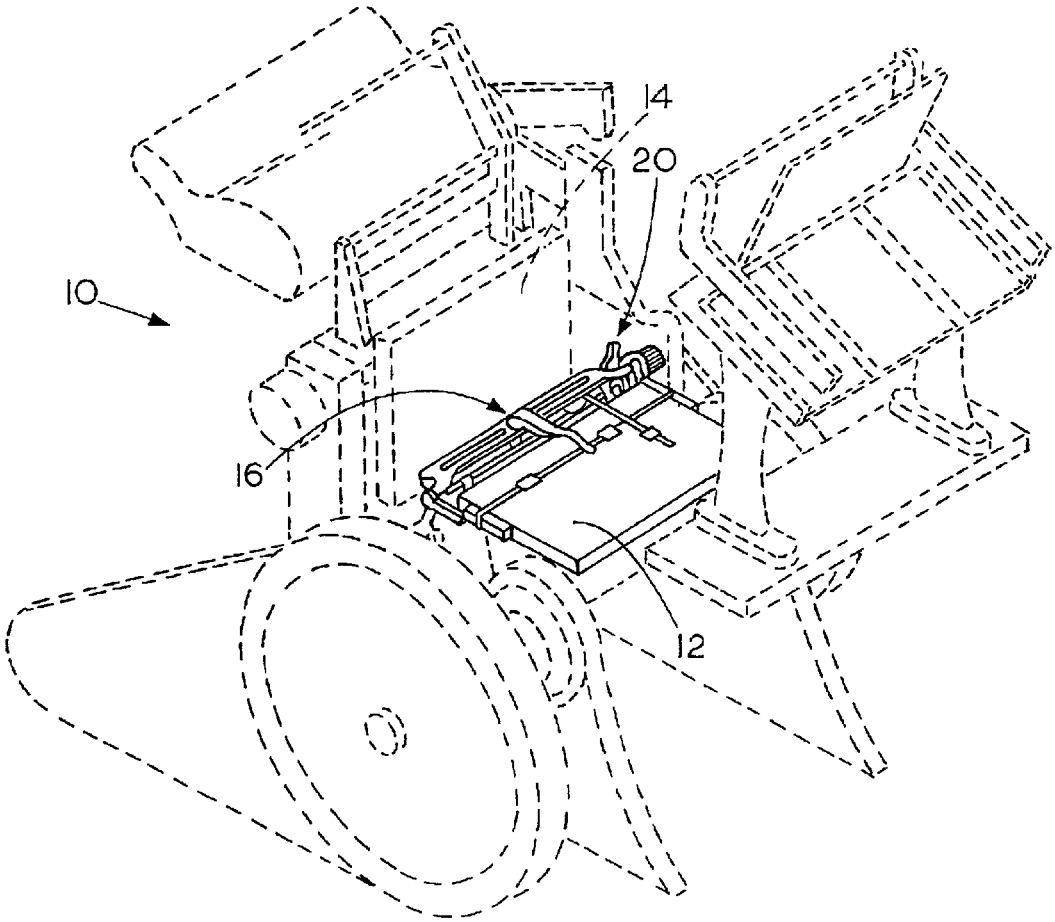
FIG. 1 is a perspective view of a printing press in accordance with of the present invention.

All Figures are drawn for ease of explanation of the basic teachings of the present invention only; the extensions of the Figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in various Figures of the drawings, the same numerals designate the same or similar parts. Furthermore, when the terms "top," "bottom," "right," "left," "forward," "rear," "first," "second," "inside," "outside," and similar terms are used, the terms should be understood to reference only the structure shown in the drawings as it would appear to a person viewing the drawings and utilized only to facilitate describing the illustrated embodiment.

DETAILED DESCRIPTION OF THE INVENTION

A platen press 10 in accordance with the present invention is illustrated generally in FIG. 1. Platen press 10 is illustrated as a Kluge type Platen Press for exemplary purposes only. Platen press 10 includes a platen assembly 12 to receive the print media 90, shown in FIGS. 2A and 2B. Platen assembly 12 is rotatably attached to platen press 12 to permit media 90 to be brought into contact with a form or die secured to a back-plate 14. The contact of print media 90 with the die transfers or prints the images onto print media 90. Typically, print media 90 is any of the various types of papers, cardboards or other materials on which printing is desired and is typically provided as individual sheets. The forms or dies include the letters, symbols or designs to be printed on print media 90 and are typically positioned within the frames using furniture and keys, not shown. A register assembly 16 is attached to platen assembly 12 to precisely position print media 90 on platen assembly 12. Registration assembly 16 transversely aligns printing medium 90 to either to the right for a "gear side" register or to the left for an "operator side" register on platen assembly 12 with the between the two typically being dictated by the nature of the print job. The Figures and description illustrate and describe the right side registration of print media 90 for exemplary purposes only. Those skilled in the art will readily understand that the application of the present invention to left side registration upon review of this disclosure, as well as the application of the principles of the present invention to other printing presses requiring the registration of print media.

Figure 2A:
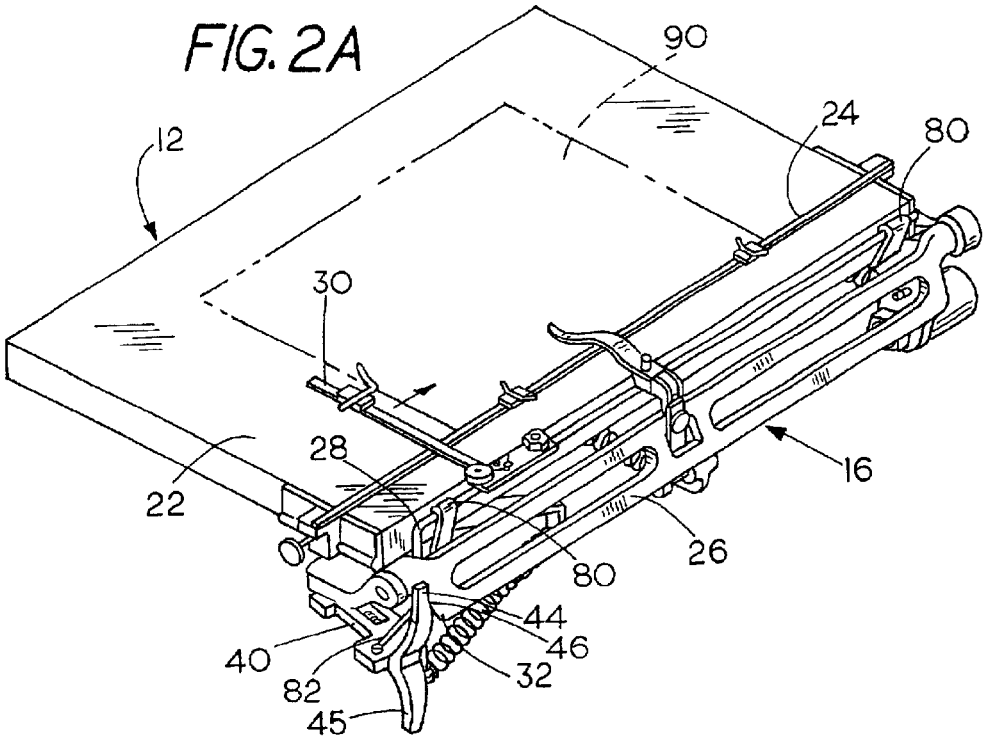
FIG. 2A is a perspective view of the platen assembly, illustrating the gripper bar in a lowered position.
Figure 2B:
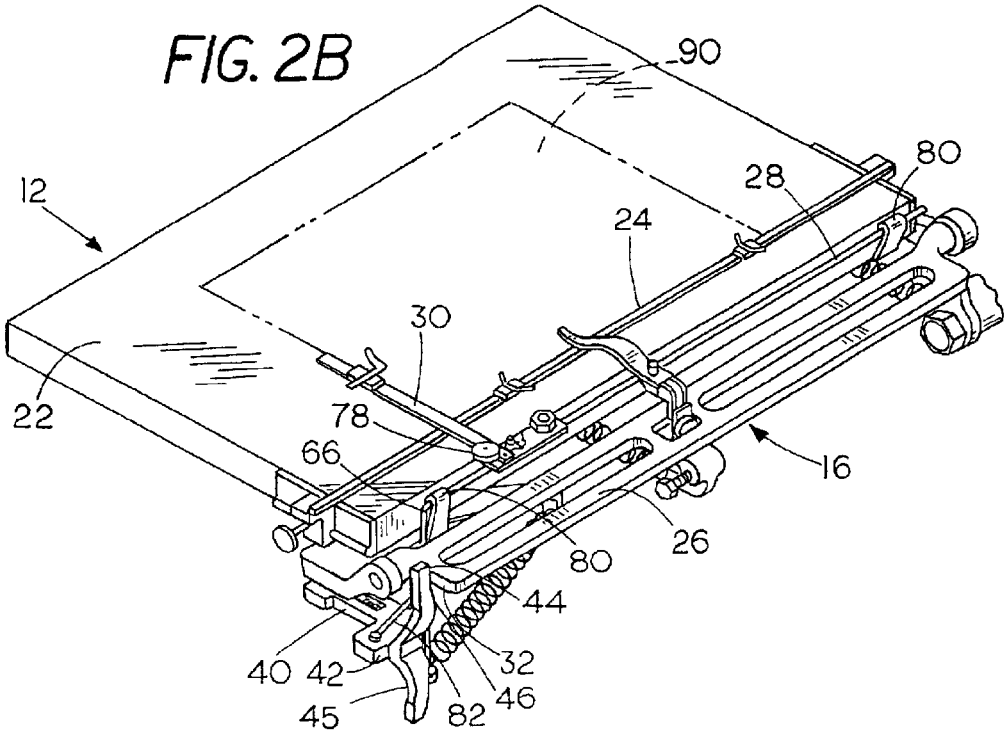
FIG. 2B is a perspective view of the platen assembly shown in FIG. 2A, illustrating the gripper bar in a raised position.
Figure 3:
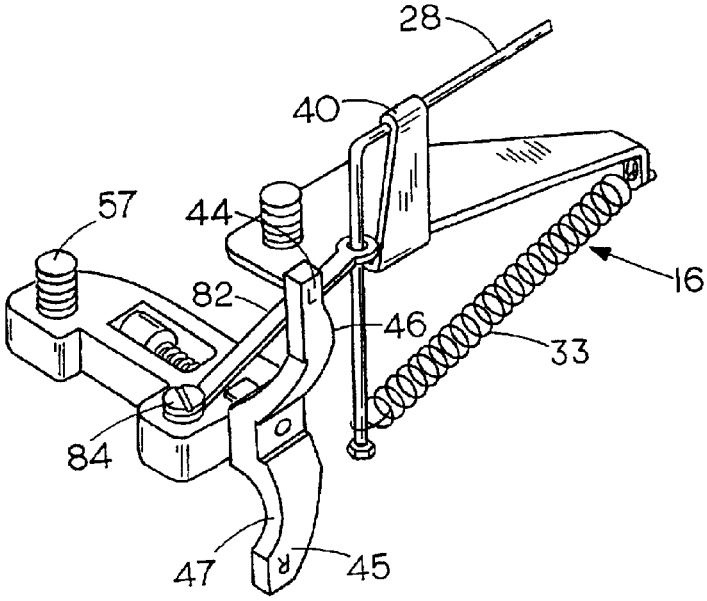
FIG. 3 is a partial perspective view of a register assembly in accordance with the present invention.

FIGS. 2A, 2B and 3 illustrate an embodiment of a registration assembly in accordance with the present invention. FIGS. 2A and 2B illustrate registration assembly 16 having a gripper bar 26 in a lowered and raised configuration, respectively, relative to the platen 22 of platen assembly 12. For purposes of the present application, registration assembly 16 includes a gripper bar 26, a register cam 40, a register rod 28, and a register gauge 30. Platen assembly 12 includes a platen 22 and an alignment bar 24. Platen 22 of platen assembly 12 typically has an upper surface which is at least in part flattened to receive print media 90. Alignment bar 24 is mounted to platen 22 and restricts the vertical movement of print media 90 over the top surface of platen 22. The platen assembly 22 is generally mounted to aspects of printing press 10 to enable the top surface of platen 22 to be brought into contact with the form or die positioned adjacent to back-plate 14, as shown in FIG. 1, to print an image on print media 90.

As illustrated, gripper bar 26 is mechanically driven between the lowered position, shown in FIG. 2A, and the raised position, shown in FIG. 2B. An edge 32 of gripper bar 26 is in contact with either a first face 46 or a second 47 of register cam 40. As gripper bar 26 raises and lowers, register cam 40 is displaced by edge 32 of gripper bar 26. Although register cam 40 may be otherwise movably connected to an aspect of register assembly 16 or platen assembly 12, register cam 40 is typically hinged to an aspect of register assembly 16 or platen assembly 12 so that the axis of rotation is fixed relative to platen assembly 12. As illustrated for exemplary purposes, register cam 40 is rotatably connected to register assembly 16 by a rod 57 extending through a bore 85 in body 42. Being movably connected, register cam 40 is displaced as edge 32 of gripper bar 26 follows either a first profile first face 46 or a second profile of a second face 47 of register cam 40 as the gripper bar 26 moves between a raised and a lowered position. As illustrated for exemplary purposes, first face 46 of register cam 40 is biased against edge 32 of gripper bar 27 by a spring 33. The movement of register cam 40 is communicated to registration rod 28. Typically, the movement is communicated through a mechanical connection between register cam 40 and registration rod 28, such as by a connecting member 82, shown in FIG. 3. As shown, connecting rod 82 is secured at a first end to body 42 of register cam 40 by a screw 84 extending through a threaded bore 87 extending into body 42. An eyelet is provided at a second end of connecting rod 82 as an exemplary method for connecting registration rod 28 to connecting rod 82. As illustrated, registration rod 28 passes through the eyelet of connecting rod 82 to mechanically connect the two elements. To facilitate its movement, registration rod 28 is typically slidably secured to registration assembly 16 by one or more rod guides 80. The movement communicated from register cam 40 to registration rod 28 moves registration rod 28 transversely relative to platen 22 through guides 80. Registration gauge 30 is connected to registration rod 28 and is positioned adjacent to platen 22. Thus, registration gauge 30 is moved transversely relative to platen assembly 12 as registration rod 28 is transversely displaced by register cam 40. Generally, the register gauge 30 is positioned on registration rod 28 so that when a piece of print media 90 is placed on platen 22 that a vertical edge of guage 30 cocsist the piece of print media 90 to register the media to the right, for example.

During operation of printing press 10, register cam 40 determines the rate, distance and direction that register gauge 30 moves. Particularly, the profile of the face 46 or 47 of register cam 40 that is in contact with gripper bar 26 controls at least in part the parameters for the transverse movement of register gauge 30. As illustrated in FIGS. 2A, 2B, and 3 and as discussed above, a face 46 or 47 of cam arm 40 serves as a bearing surface which is generally maintained in substantially constant contact with edge 32 of gripper bar 26. In the embodiment shown, edge 32 is maintained in substantial contact with face 46 under the tension of a spring 33 for exemplary purposes. Those skilled in the art will recognize a wide variety of elements and configurations that would maintain substantial contact between face 46 and edge 32 as gripper bar 26 moves. Thus, spring 33 maintains contact between face 46 or 47 and edge 32 of gripper bar 26 to displace cam 40 as gripper bar 26 moves between the raised and lowered positions.

FIGS. 4, 5, 6, 7A and 7B illustrate an embodiments of a register cam 40 in accordance with the present invention. Generally, register cam 40 permits the changing of the cam profiles without requiring the removal of register cam 40 from printing press 10. In the embodiment shown in FIGS. 4, 5, and 6, register cam 40 comprises a body 42 with a first cam arm 44 and a second cam arm 45 extending from body 42. First cam arm 44 includes a first face 46 and second cam arm 45 includes a second face 47. First face 46 having a first profile to follow gripper bar 26 and second face 47 having a second profile to follow gripper bar 26. In the embodiment shown in FIGS. 7A and 7B, register cam 40 comprises a body 42 with a single cam arm 43 extending from body 42. Cam arm 43 includes both a first face 46 and a second face 47. Each of the faces 46 and 47 presented by both of the above described embodiments has a distinct profile. That is, first face 46 has a first profile to follow gripper bar 26 and second face 47 has a second profile to follow gripper bar 26. The particular profile of face 46 or 47 in contact with edge 32 of gripper bar 26 determines the direction, distance and rate of registration.

Figure 4:
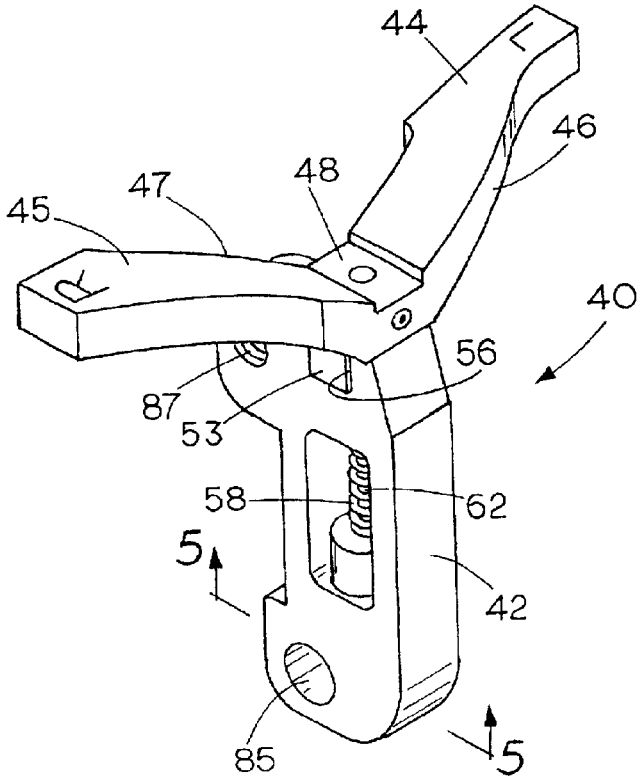
FIG. 4 is a perspective view of an embodiment of a register cam in accordance with the present invention.
Figure 5:
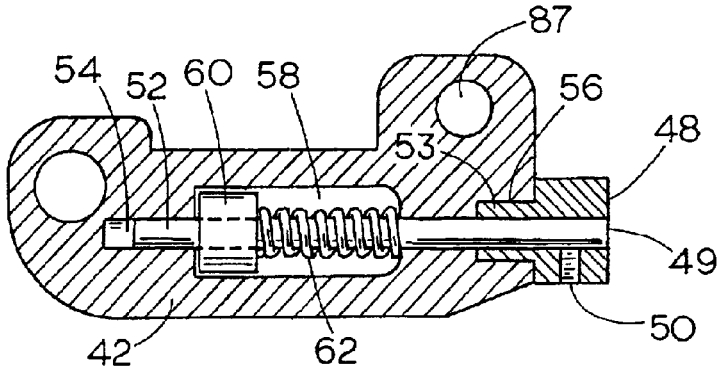
FIG. 5 is a side view in partial cross-section of a register cam in accordance with the present invention taken along line 5—5 of FIG. 4.
Figure 6:
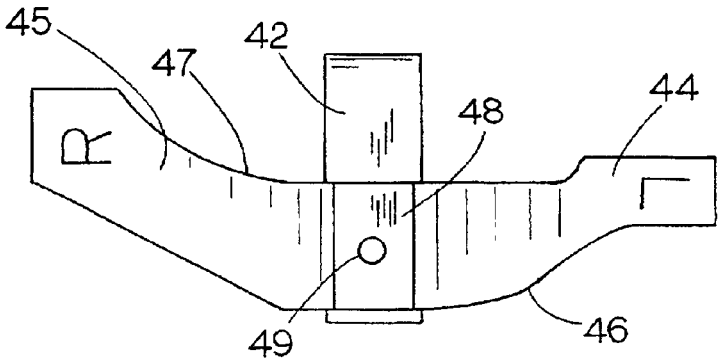
FIG. 6 is an end elevational view of an embodiment of a register cam in accordance with the present invention.

As illustrated in FIGS. 4, 5 and 6, first face 46 of first cam arm 44 has a first profile resulting in a left registration of print media 90, not shown, and second face 47 of second cam arm 44 has a second profile resulting in a right registration of print media 90. Alternatively, both the first face 46 and the second face 47 can have profiles resulting in one of right or left registration of the print media but, have their profiles unique from one another in that the timing, rate or distance of the resulting registration varies between as a result of the difference in profiles of first face 46 and second face 47.

In the embodiment of FIGS. 4, 5, and 6, cam arms 44 and 45 are connected at an axis 48. Axis 48 can be a distinct element connecting the two cam arms 44 and 45 or may be the junction where the two cam arms 44 and 45 come together. Axis 48 can further include a longitudinal bore 49 extending through axis 48. Further, axis 48 can include a transverse bore 50 to receive a set screw 51. In one embodiment, a shaft 52 is secured within longitudinal bore 49 by set screw 51. In other embodiment, shaft 52 can be secured to axis 48 by welding, by being integrally molded or formed with axis 48 or otherwise connected to axis 48 as will be recognized by those skilled in the art upon review of the present disclosure. In the embodiment shown in FIGS. 4, 5 and 6, a detent 53 also extends from the bottom, as shown in FIG. 4, of axis 48. Detent 53 can be coaxial with shaft 52 and cooperates with body 42 to prevent the rotation of cam arms 44 and 45 relative to body 42 about a longitudinal axis defined by shaft 52.

Body 42, as shown in the FIGS. 4, 5 and 6, includes a longitudinal bore 54, a transverse cavity 56 and a slot 58. Longitudinal bore 54 extends through body 42 and is sized to movably receive the length and diameter of shaft 52. Transverse cavity 56 is shaped to receive detent 53 and thereby cooperate with detent 53 to prevent the rotation of cam arms 44 and 45 relative to body 42 about a longitudinal axis defined by shaft 52. For exemplary purposes, transverse cavity 56 is shown to be coextensive with longitudinal bore 54. Slot 58 extends at least in part through longitudinal bore 54 so as to provide access to shaft 52 while shaft 52 is inserted into longitudinal bore 54. A set collar 60 may be secured to shaft 52 within slot 58. Set collar 60 limits the longitudinal movement of shaft 52 to retain shaft 52 within longitudinal bore 54. In addition, set collar 60 may be configured to permit detent 53 to extend outward beyond transverse cavity 56 to allow the rotation of cam arms 44 and 45 about the longitudinal axis of shaft 52. A compressible element 62 may also be provided between a first end of slot 58 and the set collar 60. Compressible element 62 can provide the force that maintains detent 53 within transverse cavity 56 or can otherwise maintains elements in communication to prevent the rotation of the one or more arms 44 and 45 relative to body 42. Compressible element 62 may be a coil spring, a leaf spring, a compressible rubber collar, or other compressible element that will be recognized by those skilled in the art upon review of the present disclosure.

To utilize the above described embodiment of the present invention, a user stops printing press 10 and applies a longitudinal force to axis 48, typically through arms 44 and 45, to draw detent 53 from transverse cavity 56. Once the bottom aspect of detent 53 has cleared the upper aspect of transverse cavity 56, the user may rotate arms 45 and 46 about the longitudinal bore 54. Once the alternative arm 45 or 46 is properly oriented, the user releases arms 44 and 45 permitting detent 53 to withdraw back into transverse cavity 56 to lock the alternative arm 44 or 45 in a position to contact gripper bar 26 and thus, regulate the transverse movement of registration gauge 30.

Figure 7A:
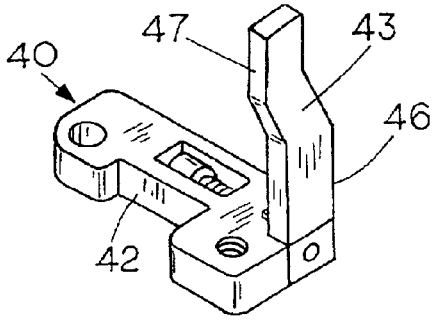
FIG. 7A is a perspective view of another embodiment of the present invention having a cam arm in a first position.
Figure 7B:
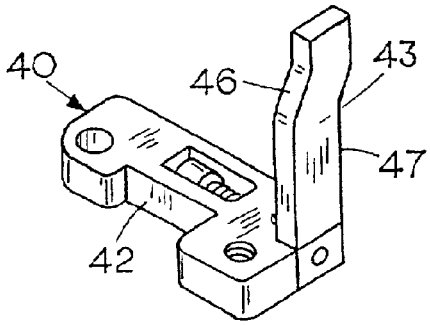
FIG. 7B is a perspective view of the embodiment of FIG. 7A having the cam arm in a second position.

The embodiment of the register cam 40 illustrated in FIGS. 7A and 7B includes only a single cam arm 43 extending from body 42. Cam arm 43 includes a plurality of faces 46 and 47 with each face 46 and 47 having a distinct profile to confer particular movement characteristics to register gauge 30. In the embodiment shown in FIGS. 7A and 7B, cam arm 43 rotates generally about a longitudinal axis of cam arm 43. Around this axis of rotation, cam arm 43 is securable in at least a first position and a second position relative to body 42. Alternatively, cam arm 43 can be otherwise movable between and securable in a first and a second position as will be recognized by those skilled in the art upon review of the present disclosure. In the first position as shown in FIG. 7A, cam arm 43 presents first face 46 to contact edge 32 of gripper bar 26 when cam 40 is mounted to registration assembly 16. In the second position as shown in FIG. 7B, cam arm 43 presents second face 47 to contact edge 32 of gripper bar 26 when cam 40 is mounted to registration assembly 16.

To utilize the embodiment of the present invention having a single cam arm 43, a user stops printing press 10 and applies a force along the longitudinal axis of arm 43 to release arm 43 from body 42 by, for example, withdrawing a portion of arm 43 from a cavity or groove within body 42. Once the portion of arm 43 is withdrawn from the cavity or groove within body 42, the user may rotate arm 43 about longitudinal axis of arm 43. Once the alternative face 46 or 47 is properly oriented, the user releases arm 43 permitting the portion of arm 43 to again cooperate with the cavity or groove within body 42 lock arm 43 in a position to present the alternative face 46 or 47 to gripper bar 26 to regulate the transverse movement of registration gauge 30.

Since the invention disclosed above may be embodied in other specific forms without departing from the spirit or general characteristics thereof, some of which forms have been indicated, the embodiments described in the present disclosure are to be considered in all respects illustrative and not restrictive. The scope of the invention is to be indicated by the appended claims, rather than by the above description, and all changes which come within the meaning and range of equivalency of the claims are intended to be embraced by the claims.

What is claimed:

1. A register cam for use on a printing press, comprising:

a body;

at least two cam arms extending outwardly from the body;

further comprising the at least two cam arms movably connected to the body to permit the at least two cam arms to be locked in one of a first position and a second position relative to the body; the body including a longitudinal bore and a transverse cavity; and the at least two cam arms secured to one another at an axis, the axis further including a detent and a rod secured to the axis and extending from the axis, the rod extending into the longitudinal bore of the body to rotatably secure the at least two cam arms to the body and the detent shaped to be received within the transverse cavity to lock the at least two cam arms in one of the first position and the second position relative to the body.

2. A register cam, as in claim 1, further comprising a set collar secured to the rod of the at least two cam arms to retain the shaft within the longitudinal bore of the body.

3. A register cam, as in claim 2, the body further comprising a slot, the slot being coextensive with at least a portion of the longitudinal bore of the body wherein the set collar is positioned within a slot; and further comprising a compressible element secured between a first end of the slot and the set collar to compressionally secure the detent within the transverse cavity of the body to prevent the rotation of the at least two cam arms relative to the body around a longitudinal axis of the rod.

4. A register cam, as in claim 3, wherein the compressible element is a coil spring positioned about the rod between the first end of the slot and the set collar.

5. A printing press, comprising:

a platen; and a register assembly secured to the platen, the register assembly including a register gauge connected to a register cam, the register cam having a first cam arm and a second cam arm, one of the first cam arm and the second cam arm contacting a gripper bar to transversely move the register gauge over the platen to align a printing medium on the platen prior to printing.

6. A printing press, as in claim 5, further comprising a register rod secured to the register gauge and secured to the register cam to connect the register gauge to the register cam.

7. A printing press, as in claim 6, wherein the register cam is adjustable between a first position and a second position, the first cam arm contacting the gripper bar when the register cam is in the first position and the second cam arm contacting the gripper bar when the register cam is in the second position.

* * * * *